US007416782B2

(12) United States Patent
Renaudin et al.

(10) Patent No.: US 7,416,782 B2
(45) Date of Patent: Aug. 26, 2008

(54) GLASS FIBER ROVING

(75) Inventors: Jean-Pierre Renaudin, St-Sulpice (FR); Marc Guinet, Nances (FR); Jean-Louis Thiriet, Chambery (FR); Jean-Charles Vanderlynden, Albertville (FR); Pierre Juttet, La Terrasse (FR)

(73) Assignee: OCV Intellectual Capital, LLCDE (US)

( * ) Notice: Subject to any disclaimer, the term of this patent is extended or adjusted under 35 U.S.C. 154(b) by 360 days.

(21) Appl. No.: 10/512,419

(22) PCT Filed: Apr. 23, 2003

(86) PCT No.: PCT/FR03/01281

§ 371 (c)(1),
(2), (4) Date: Aug. 31, 2005

(87) PCT Pub. No.: WO03/093545

PCT Pub. Date: Nov. 13, 2003

(65) Prior Publication Data

US 2006/0083916 A1 Apr. 20, 2006

(30) Foreign Application Priority Data

May 2, 2002 (FR) ..... 02 05497

(51) Int. Cl.
*B32B 19/00* (2006.01)

(52) U.S. Cl. ..... 428/357; 428/375; 57/246; 57/208

(58) Field of Classification Search ..... 428/357, 428/364, 375; 57/246, 208
See application file for complete search history.

(56) References Cited

U.S. PATENT DOCUMENTS

| | | | | |
|---|---|---|---|---|
| 4,802,331 | A | 2/1989 | Klink et al. | |
| 5,486,416 | A * | 1/1996 | Johnson et al. | 428/357 |
| 5,520,984 | A * | 5/1996 | Gulino | 428/107 |
| 5,731,084 | A * | 3/1998 | Smith | 428/399 |
| 5,989,711 | A * | 11/1999 | Moireau et al. | 428/378 |
| 6,254,816 | B1 * | 7/2001 | Klaus et al. | 264/171.1 |
| 2001/0009719 | A1 | 7/2001 | Klaus et al. | |

* cited by examiner

*Primary Examiner*—N Edwards
(74) *Attorney, Agent, or Firm*—Margaret S. Millikin

(57) ABSTRACT

A strand based on glass fibers with a $\tau/\mu^2$ ratio greater than 9, where $\tau$ is the yardage of the strand in tex and $\mu$ is the filament diameter in μm. The strand has at least 6000 filaments with a yardage greater than 1200 tex and a filament diameter greater than 11 μm.

10 Claims, 2 Drawing Sheets

GLASS FIBER ROVING

TECHNICAL AND INDUSTRIAL APPLICABILITY OF THE INVENTION

The invention relates to a strand made up of a plurality of filaments based on glass fibres. The strand is in the form of a package known as a roving.

BACKGROUND OF THE INVENTION

Rovings are intended for many uses. As far as composite materials are concerned, rovings constitute the reinforcement used in plastics. Methods for using glass fibre rovings are very varied. Among these methods, mention may be made of:

A—Weaving and other methods using textile machinery, leading to flat woven or nonwoven reinforcements.

The fabrics and other heavy reinforcements based on rovings (about 1000 g/m$^2$ or greater) are used above all for the manufacture of composite components which may be very highly mechanically stressed. They find an application in parts used in static applications, such as panels for isothermal box bodies of refrigerated trucks, or alternatively in parts used in dynamic applications such as the blades of wind machines which experience high vibrational oscillations.

B—Pultrusion which consists in impregnating a reinforcement of continuous yarns with resin then in forming it by pulling it through a heated mould (die) which cures the profiled structure thus produced. This method allows for the manufacture of oblong reinforcing products, such as strips or elements for producing gratings.

C—Thermoplastic extrusion which consists in manufacturing thermoplastic granules containing so-called long fibres, the continuous fibres being introduced into an extruder and coated with the plastic on leaving the extruder to be cut into granules. This method makes it possible to obtain reinforced parts for building motor cars.

D—Filament winding which consists in winding a resin-impregnated continuous-fibre reinforcement under constant tension onto a rotating mandrel of appropriate shape so as, after curing, to form a hollow body of revolution such as a pipe.

SUMMARY OF THE INVENTION

The invention relates more specifically to strands intended for manufacturing reinforcements from rovings, the yardage of which is currently as high as 1200 tex or more, with a filament diameter of 12 μm or more. Let us remember that the yardage of a yarn or of a strand corresponds to its linear density (1 tex=1 g/km). The yardage varies in proportion to the square of the diameter of the filaments and in proportion to the number of filaments of which it is made.

The yardage is a factor governing its mechanical strength, while the diameter of the filaments influences the ability of the yarn or of the strand to curve, and therefore the flexibility of the fabric that can be obtained. The higher the yardage, the stronger the yarn, and the higher the diameter of the filaments, the more difficult it is to bend.

Rovings are obtained either directly from filaments from a bushing and assembled under the bushing into a single wound strand (these are known as direct rovings), or indirectly from yarns from primary packages known as cakes and which are assembled to from a final strand with the desired yardage (these are known as assembled rovings).

The maximum number of filaments that make up a direct roving strand is limited by the number of holes in the bushing from which the streams of glass flow, which streams, after mechanical drawing, form the said filaments. The number of filaments is strictly equal to the number of holes in the bushing. This number of holes currently does not exceed about 4000, or perhaps 4500, which allows direct rovings, for example 1200 tex/12 μm, 2400 tex/17 μm or 4800 tex/24 μm or even 9600 tex/33 μm rovings to be obtained.

It is common practice for the diameter of the filaments and the number of filaments to be expressed in whole numbers; to simplify things, the number of holes in the bushing and the number of filaments in the strand are stated in round hundreds (for example, a strand consisting of 4024 filaments will be said to be a 4000 filament strand). The round figure may differ from the exact number by a few tens.

As to the diameter of the filaments, this is a nominal value, conventionally expressed in a whole number of microns. It generally differs from the mean value of the diameter of all the filaments of which the strand is made by less than 0.5 μm.

Hence, in what follows of the text, the whole numbers should be considered to be rounded values.

For certain applications, for example blades of wind machines which over time experience a fatigue phenomenon due to the near-constant stresses caused by the wind, it would be desirable for the yardage, currently at 2400 tex, to be even higher so as, on the one hand, to simplify the method of blade manufacture and, on the other hand, allow the manufacture of blades of very large size (measuring 40 metres and more), something which currently requires a great many layers of reinforcement.

It is possible to increase the yardage of roving by increasing the diameter of the filaments and/or the number of them.

Increasing the diameter is easier to achieve but is not always desirable because this makes the strand more difficult to bend and makes weaving more difficult and leads to lower-quality products. Weaving is often interrupted by filaments breaking, the fabric is often defective given the flatness and uniformity requirements of dynamic applications in particular. Furthermore, the area of glass offered for contact with the impregnation resin is lower, the glass-resin adhesion is therefore not as good and the mechanical performance of the composite is poorer. For these reasons, certain professions have devised standards limiting the permissible filament diameter to 17 μm.

In the case of pultrusion, strands these days have yardages ranging up to 4800 tex; for productivity and component size reasons, it is also desirable to increase the yardage, but increasing the diameter of the filaments leads to difficulties in using such strands as the filaments break and form sorts of spines which, on the one hand, prick and injure the operators and, on the other hand, soil the resin with which the reinforcement is impregnated. For this reason, converters in this case demand that the filament diameter should not exceed 24 μm, and some even demand that this diameter not exceed 19 μm.

It is therefore preferable to increase the yardage by increasing the number of filaments.

Increasing the number of filaments is achieved either by combining several strands from a plurality of cakes, something which does not simplify manufacture and rather contributes to an increase in costs, or by combining several strands of filaments from several bushings grouped together on the same winder, but this is not without cause for concern over the efficiency because of the statistical rise in the number of breakages of the overall strand because of the dependency on a plurality of bushings.

Furthermore, the inventors have demonstrated that combining a plurality of strands had disadvantages that could prove prohibitive to the quality of the sold package and of the product manufactured from the package. Thus, in the case of the combination of several strands from cakes, the package obtained has loops on its edge face, something which is inappropriate in terms of presentation for sale, and there is a risk that these loops may cause the strand to become entangled while it is being paid out, for example during weaving. When filaments from a plurality of bushings are combined, even if the package obtained has no apparent defects, there is a tendency of the strands of filaments to separate during pay-out, one then being pulled more than the other (or others) during weaving for example. This inequality in the tension detracts from the flatness of the fabric which will tend to curl, and the fabric will not, amongst other things, be able to be impregnated with resin properly, and this will result in poorer mechanical properties of the composite material.

It is therefore an object of the invention to provide a strand based on glass fibres which has a yardage higher than or the same as those which exist on the market, without being accompanied by an increase in the diameter of the filaments, while at the same time maintaining quality at least equivalent (particularly during use), and maintaining simplicity in the manufacture.

According to the invention, the strand is characterized by the $$\frac{\tau}{\mu^2}$$

ratio which is greater than 9, where $\tau$ is the yardage of the strand in tex and $\mu$ is the diameter of the filaments in μm.

According to a feature, the strand comes from a single bushing. The strand can be a roving directly wounded under the bushing.

According to another feature, the strand comprises at least 6000 filaments, with a yardage higher than 1200 tex, and with a filament diameter higher than 11 μm.

For example, the strand comprises 8000 filaments each 17 μm in diameter and has a yardage of 4800 tex. This type of strand is particularly suited to the manufacture of unidirectional or multi-axial reinforcements used in particular for wind machine blades. Indeed, the diameter of the filaments remains the same as the 17 μm diameter that exists on the market for wind machine blades; weaving is thus not made any more difficult. Further, the yardage is advantageously higher than the existing yardage, 2400 tex for a diameter of 17 μm, leading to a heavier reinforcement.

According to another example, the strand comprises 8000 filaments each 24 μm in diameter and has a yardage of 9600 tex. Such a strand is valued for the manufacture of very long, small cross section profiled parts using the pultrusion method.

By way of another example, the strand comprises 8000 filaments each 12 μm in diameter and has a yardage of 2400 tex for the manufacture of strips using the fine pultrusion method.

Thus, the strand of the invention can be used in the manufacture of composite materials via the methods of weaving, pultrusion or extrusion or filament winding and a particular application is for example wind machine blades.

Finally, the strand can be made up completely of glass filaments or can be composite and made up of comingled glass filaments and thermoplastic filaments.

Such strands are therefore obtained by increasing the number of filaments drawn from the bushing, making it necessary to have bushings with higher numbers of holes than in the prior art.

Hitherto, packages with such a high number of filaments which may, for example, reach a count of 8000 as here in the invention, and originating from a single bushing, did not exist on the market because the current glass fibre drawing plants are designed to take bushings of established sizes provided with about 4500 orifices at most. To increase the number of orifices further, it would be necessary for the same bushing area, to position the orifices even more close together, which would bring the filaments flowing therefrom closer together. There would then be an almost certain risk of the filaments joining and sticking together, thus impeding the fibre drawing method.

Now, no one hitherto considered the possibility of manufacturing new bushings the ends of which had a greater number of orifices, up to twice the existing number, by increasing the end area of the bushing pierced with the said orifices while at the same time being able to incorporate it into an existing fibre drawing plant. Hence, according to the invention, the device for manufacturing the strand of the invention comprises a bushing the end of which consists in a plate provided with more than 4500 orifices, particularly 8000 orifices, and with an area greater than that of an existing plate currently provided with 4500 orifices at most.

BRIEF DESCRIPTION OF THE DRAWINGS

Other advantages and features of the invention will become apparent from reading the description which follows, with reference to the attached drawings in which.

DETAILED DESCRIPTION AND PREFERRED EMBODIMENTS OP THE INVENTION

Figure 1:
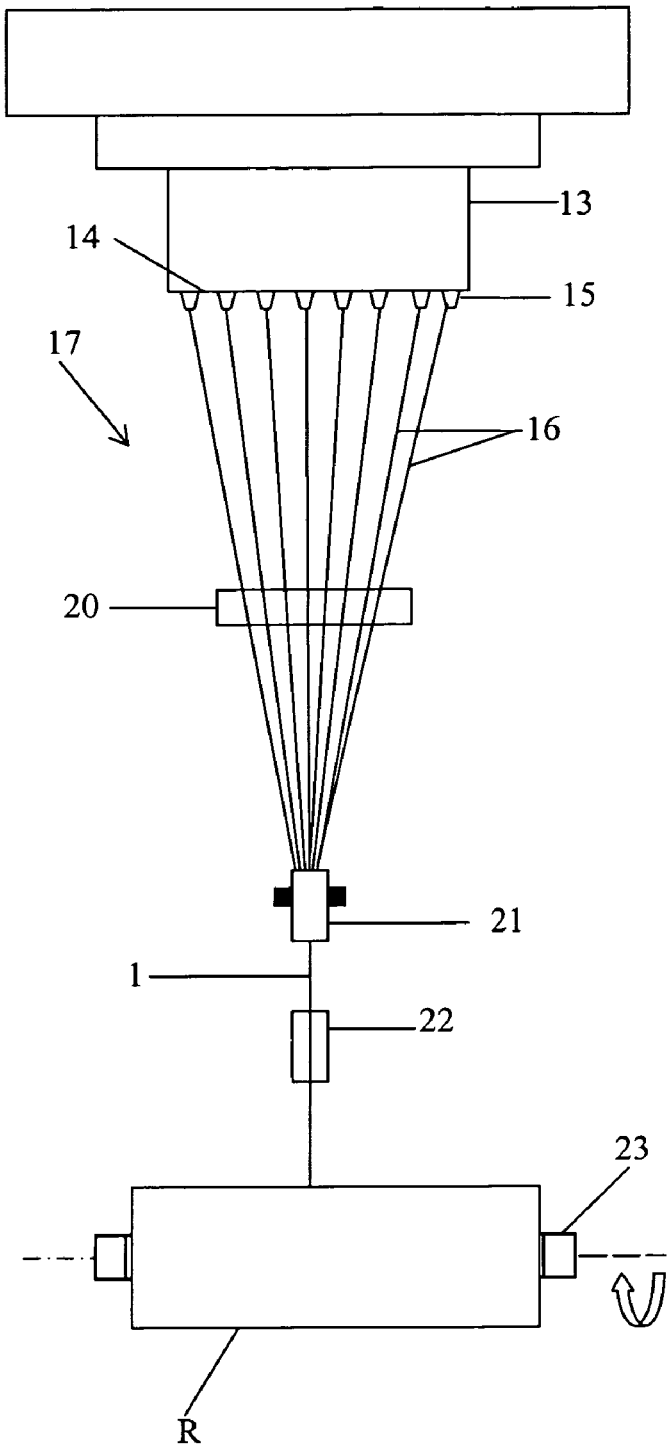
FIG. 1 schematically illustrates the device for manufacturing a strand according to the invention.

The strand of glass fibres 1 of the invention consists of more than 4000 filaments from a single bushing 10 as visible in FIG. 1. The strand 1 is wound to constitute a direct roving R.

The composition of the glass is that of E-glass.

The bushing unit 13 is equipped at the end with a plate 14 which is provided with a multitude of orifices 15, such as nozzles, from which the molten glass flows before being drawn into a multiplicity of filaments 16. The number of orifices is higher than 4500, preferably higher than 6000, and reaches a count for example of 8000, and even is beyond 8000.

The filaments are assembled into a single web 17 which comes into contact with a coating device 20 intended to coat each filament with size of an aqueous or anhydrous type. The device 20 may consist of a bath fed constantly with a sizing solution and of a rotating roller the lower part of which is constantly immersed in the solution. This roller is constantly covered with a film of size which is picked up by the filaments 16 from its surface as they slide past.

The web 17 then converges towards an assembly device 21 where the various filaments are brought together to form the strand 1. The assembly device 21 may consist of a simple grooved pulley or of a notched plate.

The strand 1, on leaving the assembly device 21, enters a yarn guide 22 to be wound around a support 23 of horizontal axis with respect to the vertical arrival of the yarn at the yarn guide, The strand is thus wound directly from the busing to constitute the direct roving R. The speed of drawing is usually between 10 and 60 metres per second.

The bushing end plate 14 is therefore designed with more than 4500 orifices, in this instance 8000 orifices, to form 8000 filaments. The increase in the number of filaments thus supplied over the existing number in the prior art which did not exceed 4500, is of real benefit. For certain applications, in order to achieve a constant given yardage, it is preferable for the number of filaments to be increased by reducing their diameter or keeping it constant rather than to have fewer filaments of larger diameter. Thus, a fabric that needs to be impregnated with resin will demonstrate better fatigue strength in dynamic use when the area for contact between the resin and the glass filaments is higher. Now, this closeness of contact, for identical sizing of a 4800 tex strand, is better with a constitution of 8000 filaments 17 μm in diameter rather than 4000 filaments 24 μm in diameter. The factor by which the closeness of contact is multiplied between 8000 and 4000 filaments is about 1.4.

Such a strand of 8000 filaments 17 μm in diameter with a yardage of 4800 tex will find application in particular in the manufacture of unidirectional and multiaxial reinforcements for reinforcing wind machine blades.

It is recalled that the number of filaments, the strand yardage and the filament diameter are connected by the following formula:

$$\frac{f}{490} = \frac{\tau}{\mu^2}$$

where f is the number of filaments, τ is the yardage and μ is the diameter in μm, 490 being a multiplying factor incorporating the density of the glass.

Thus, the strand according to the invention comprising more than 4500 filaments may also be characterized by a $$\frac{\tau}{\mu^2}$$

ratio greater, in integer value, than 9. While it is not easy once the product is on the market to count up the number of filaments in a strand, it is, however, easier to calculate the $$\frac{\tau}{\mu^2}$$

ratio having measured τ and μ using the standardized ISO1889 and ISO1888 methods respectively.

Figure 2:
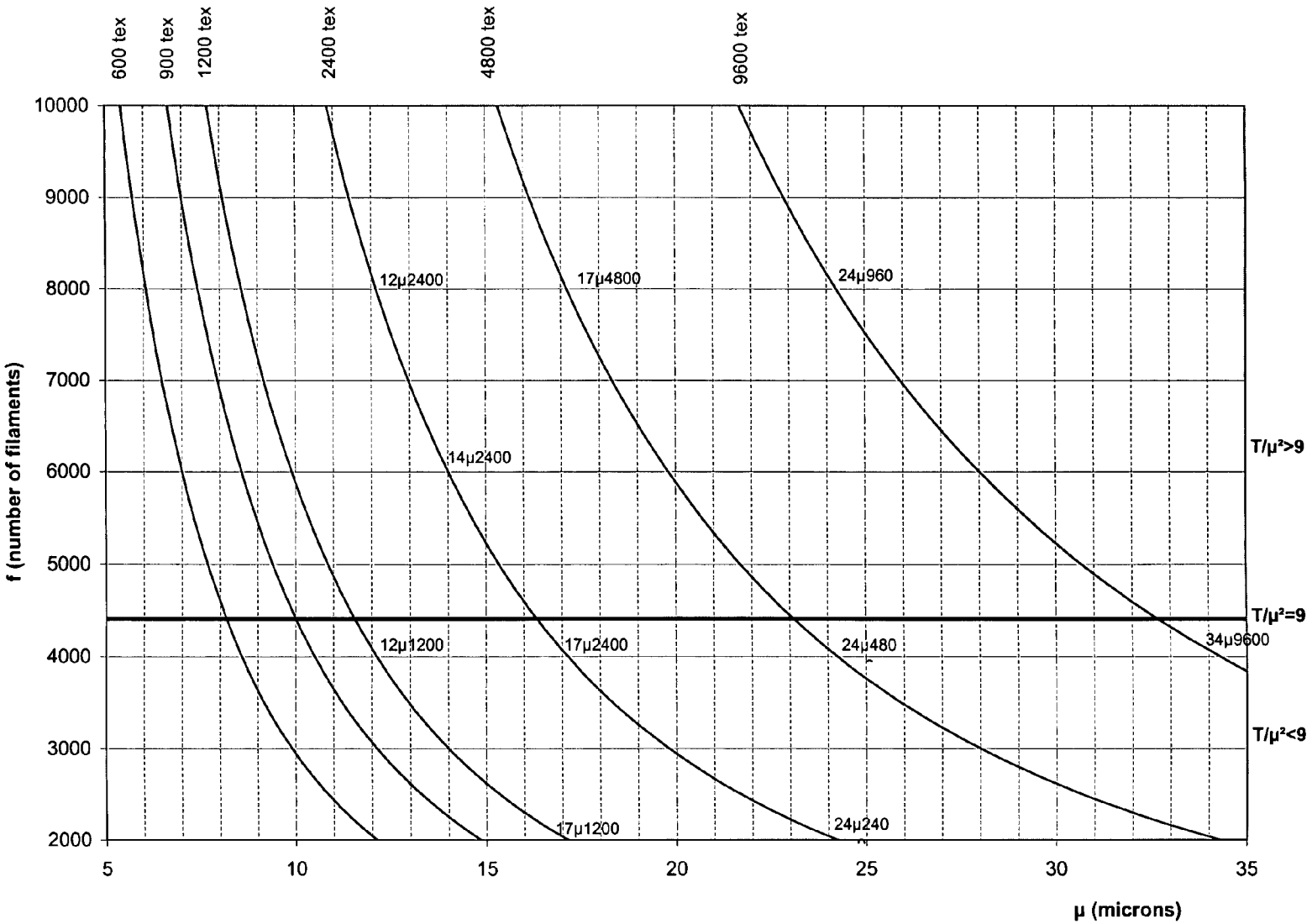
FIG. 2 illustrates curves representing, according to the yardage of a strand, the number of filaments in the strand as a function of the diameter of the filaments.

FIG. 2 illustrates a series of curves expressing, according to the yardage of the strand, the number of filaments as a function of the diameter of the filaments. The reference straight line $$\frac{\tau}{\mu^2} = 9$$

which constitutes the lower limit met by the strand of the invention has been plotted. Bushings with more than 4500 holes (exactly 4410 holes) make it possible to obtain a $$\frac{\tau}{\mu^2} \text{ ratio} > 9,$$

while existing bushings with 4000 holes or fewer do not meet this characteristic.

Thus, by increasing the number of filaments, we have managed to increase the yardage of the strand without it thereby altering the diameter of the filaments. For 17 μm, the yardage is just 2400 tex with a 4000-hole bushing, whereas it is 4800 tex (twice that value) for an 8000-hole bushing.

Furthermore, the increase in the number of filaments makes it possible, without increasing the yardage, to reduce the diameter of the filaments. For 4800 tex, the strand has filaments 24 μm in diameter with 4000 filaments, whereas the diameter is just 17 μm for 8000 filaments.

It is also possible to produce strands with a yardage of 600 or 900 tex for example, the filament diameters of which do not exceed 8 or 10 μm respectively.

Hence, the invention, which consists in supplying a strand for which $$\frac{\tau}{\mu^2} > 9,$$

makes it possible to obtain products which are novel by comparison with the existing ones which have:

for the same yardage, a reduction in the filament diameter, thus allowing the filaments to maintain their flexibility and prevent them from breaking, and this therefore avoids the build-up of these broken filaments in the form of wadding which disrupts the operation of the machines and detracts from the uniformity of impregnation; or alternatively for constant diameter, an increase in the yardage, thus making it possible to obtain heavier reinforcements in order thus to manufacture larger components entailing a greater amount of reinforcement, and to do so without increasing the number of packages used, and therefore without complicating conversion and without needing new plants. This improves productivity both for the fibre manufacturer and for the converter.

In both instances, the issue is one of improving the quality/price ratio. The table below summarizes, for various types of application, the characteristics of the existing strands for conversion and those that can be obtained according to the invention.

| Application | Conversion | State of the art (4000 filaments) | Strand of the invention (8000 filaments) | Advantages |
|---|---|---|---|---|
| Wind machine blades | Weaving or manufacture of nonwovens | 17 μm, 2400 tex | 17 μm, 4800 tex | Productivity, ease of work, large components |
| Sections, Gratings | Pultrusion | 34 μm, 9600 tex | 24 μm, 9600 tex | Flexibility, elimination of spines |
| Strips, sections | Fine pultrusion | 12 μm, 1200 tex | 12 μm, 2400 tex | Productivity, ease of work |
| Motor | Thermo- | 17 μm, | 17 μm, | Productivity, |

-continued

| Application | Conversion | State of the art (4000 filaments) | Strand of the invention (8000 filaments) | Advantages |
|---|---|---|---|---|
| vehicle manufacture | plastic extrusion | 2400 tex | 4800 tex | ease of work, impact resistance |

The invention is described for a strand of glass fibres but it would be just as possible to produce a composite strand of the TWINTEX® type based on glass filaments delivered by the bushing and with which thermoplastic filaments are comingled.

The invention claimed is:

1. A strand based on glass fibres having a $\tau/\mu^2$ ratio greater than 9, where $\tau$ is yardage of the strand in tex and $\mu$ is diameter of the filaments in μm, and wherein the strand includes at least 6000 filaments, with a yardage greater than 1200 tex and a filament diameter greater than 11 μm.

2. A strand according to claim 1, wherein the strand comes from a single bushing.

3. A strand according to claim 2, wherein the strand is a roving directly wound under the bushing.

4. A strand according to claim 1, wherein the strand comprises 8000 filaments each 12 μm in diameter and has a yardage of 2400 tex.

5. A strand according to claim 1, wherein the strand comprises 8000 filaments each 17 μm in diameter and has a yardage of 4800 tex.

6. A strand according to claim 1, wherein the strand comprises 8000 filaments each 24 μm in diameter and has a yardage of 9600 tex.

7. A strand according to claim 1, wherein the strand is completely made of glass filaments.

8. A strand according to claim 1, wherein the strand is a composite and is made of comingled glass filaments and thermoplastic filaments.

9. A composite material comprising the strand according to claim 1.

10. A wind machine blade comprising the strand according to claim 1.

* * * * *